US006821041B1

(12) United States Patent
Hallam et al.

(10) Patent No.: US 6,821,041 B1
(45) Date of Patent: Nov. 23, 2004

(54) SURF WAX REFILLABLE PUSH-UP STICK WITH COMB/SCRAPER CAP

(75) Inventors: Gregg Hallam, Foothill Ranch, CA (US); Diego Cueto, Monarch Beach, CA (US)

(73) Assignee: Fun Before Money, Laguna Beach, CA (US)

( * ) Notice: Subject to any disclaimer, the term of this patent is extended or adjusted under 35 U.S.C. 154(b) by 0 days.

(21) Appl. No.: 10/633,079

(22) Filed: Aug. 2, 2003

Related U.S. Application Data

(60) Provisional application No. 60/400,587, filed on Aug. 5, 2002.

(51) Int. Cl.[7] ..... B05C 17/10; B65D 25/38; B65D 83/02

(52) U.S. Cl. ..... 401/18; 401/19; 401/38; 401/52; 401/82; 401/86; 401/98; 401/128

(58) Field of Search ..... 401/7, 18, 19, 401/16, 38, 37, 82, 84, 86, 80, 52, 98, 118, 123, 127, 128, 130, 126, 195

(56) References Cited

U.S. PATENT DOCUMENTS

| | | | | | |
|---|---|---|---|---|---|
| 708,709 | A | | 9/1902 | Henneberry et al. | |
| 1,567,467 | A | * | 12/1925 | Rocherolles | 401/84 |
| 1,780,508 | A | * | 11/1930 | Schulse | 401/82 |
| 1,959,763 | A | * | 5/1934 | Marr | 401/84 |
| 2,716,251 | A | | 8/1955 | Pearce | |
| 2,886,839 | A | | 5/1959 | Leopoldi | |
| 2,902,041 | A | * | 9/1959 | Bau | 401/19 X |
| 3,133,300 | A | | 5/1964 | Freeman | |
| 3,782,600 | A | | 1/1974 | Columbus | |
| 4,652,163 | A | | 3/1987 | Karliner et al. | |
| 4,700,448 | A | * | 10/1987 | Parker | 401/82 X |
| 5,150,978 | A | * | 9/1992 | Stewart et al. | 401/82 X |
| 5,219,238 | A | * | 6/1993 | Hainbach | 401/82 X |
| 5,788,104 | A | | 8/1998 | Hoyt | |
| 6,022,582 | A | | 2/2000 | Van Tyle | |
| 6,244,773 | B1 | | 6/2001 | Geremia-Nargi | |
| 6,251,468 | B1 | | 6/2001 | Balter | |
| D449,987 | S | | 11/2001 | Owens | |
| D462,614 | S | | 9/2002 | Owens | |

* cited by examiner

*Primary Examiner*—Gene Mancene
*Assistant Examiner*—Kathleen J. Prunner
(74) *Attorney, Agent, or Firm*—Tipton L. Randall

(57) ABSTRACT

A combination solid material storage container and applicator assembly for solid materials, such as surf board wax, is disclosed. The assembly includes a symmetrical storage container member, which has an open top end, an open bottom end, and an interior surface. A pusher member is positioned inside the container member and includes a sealing lip portion, which provides a continuous seal between the pusher member and the container member interior surface. The pusher member supports a slug of solid material within the container member. An applicator cap member is releasably secured to the open top end of the container member. The cap member includes a blade portion with a scraper edge and a comb edge. The blade portion is used for manipulating the solid material once applied to a surface.

22 Claims, 7 Drawing Sheets

SURF WAX REFILLABLE PUSH-UP STICK WITH COMB/SCRAPER CAP

CROSS-REFERENCE TO RELATED APPLICATIONS, IF ANY

This application claims the benefit under 35 U.S.C. §119 (e) of provisional application Ser. No. 60/400,587, filed Aug. 5, 2002. Application Ser. No. 60/400,587 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device for storing a flowable solid material and, more particularly, to a device for applying and spreading the flowable solid material on a generally planar surface.

2. Background Information

The state of the art includes various devices for storing and applying materials to a surface. This technology is believed to have significant limitations and shortcomings, including, but not limited to, that the devices are difficult to manually manipulate in order to achieve the desired application of the materials to a surface. These devices are particularly ill suited for applying and spreading a flowable solid material to a generally planar surface. One example of such a flowable solid material is a wax that is applied to the surface of a surf board.

For this and other reasons, a need exists for the present invention. The invention provides a unique device for storing and applying a substance to a selected surface, which is believed to fulfill the need and to constitute an improvement over the background technology.

All United States patents and patent applications, and all other published documents mentioned anywhere in this application are incorporated by reference in their entirety. Some examples of devices for containing and spreading substances on various surfaces, for which patents have been granted, include the following.

Henneberry et al., in U.S. Pat. No. 708,709, describe a putty applying tool that includes a handle portion with a collapsible body portion 5 filled with putty. The end of the tool has a flat blade 8 with a portion of the blade covered by a short, hollow section 10 that delivers putty from the handle reservoir to the end of the blade.

In U.S. Pat. No. 2,716,251, Pearce discloses a resilient container formed of any suitable material, such as rubber. The container is preferably bulbous in form and provided with a large outlet 11 which is surrounded by a stiff externally threaded collar 12*a*. A tapering neck 13 having internally tapered threads 14 at its large end 36 is adapted to be screwed onto the threads 12 of the collar 12*a*. This neck is formed of stiff material and tapers to a relatively large rectangular slot 17 across its outer end. A semi-rigid flap 18 extends outwardly from one side of the end of the neck 13 and from along one side 17*a* of the slot 17. The flap 18 is formed with an outwardly extending point 19 at each opposite corner of its outer end 38. The flap 18 and the points 19 taper to a thin edge as illustrated in FIGS. 2 and 3. A stopper 20 is provided, the stopper fitting into the slot 17.

U.S. Pat. No. 2,886,839 by Leopoldi shows a cleaning device 10 embodying a compressible container 11 having a neck portion 11*a*, carrying a removable spray top 12, and adapted to serve as a handle for a sponge 13, squeegee 14, and scraper 15, all mounted on the container. In the preferred embodiment, the container is shaped as a rather flat bottle having two narrow sides 16, 17, and is molded of a resilient plastic material with the mold parting line 18 being located around the opposite narrow sides of the bottle. It is noted that by forming the container with narrow sides 16, 17 and by locating the parting line 18 down the middle of these sides, these opposite portions of the container are relatively more stiff and rigid than the adjoining flat container sides 21, 22. The parting line 18 contributes to this effect since it inherently results in a slightly thickened ridge being formed on the outer surface of the molded container.

Freeman, in U.S. Pat. No. 3,133,300, describes an applicator cap for attachment to the discharge nozzle of a collapsible tube. The cap has a substantially circular base, adapted to be removably mounted on the discharge nozzle, and two rigid upstanding spreader blades, formed integral with the cap base, and positioned crosswise thereof, with their line of intersection centered on the axis of rotation of the cap. The first blade has a stepped edge and a curved edge at its outer end, on opposite sides of its intersection with the second blade. The second blade has a curved edge and a straight edge at its outer end, on opposite sides of its intersection with the first blade. The stepped and straight edge portions are positioned at 45 degrees to the axis of the cap. The abutting side walls of adjacent blade sections with curved outer ends extend from the cap base to the extreme tip of the curved edges, at a 90 degree angle to each other.

U.S. Pat. No. 3,782,600 by Columbus shows a co-dispenser applicator which is common to both a tube of epoxy cement and a tube of hardener. The two materials are discharged through two separate, spaced spouts in the co-dispenser applicator. The cap, which seals the two outlet spouts of the co-dispenser applicator, has a spatula attached thereto. The spatula is useful for mixing and applying the epoxy cement and the hardener, which have previously been dispensed. By means of the present device, many of the advantages inherent in one package adhesive can now be imparted to two package adhesives.

In U.S. Pat. No. 4,652,163, Karliner et al. disclose a liquid applicator and scraper for applying a protective thin film of hardenable wax to glass during painting so that the surrounding area can be painted and the protective coating subsequently removed. The assembly has a liquid container with a valve assembly for discharging the liquid to a sponge upon the application of pressure to the sponge, a blade unit which fits over the portion of the liquid container on which the sponge is mounted. The blade unit has a scraper blade affixed therein for removing the protective coating of wax after painting, and a cap for covering the portion of the blade unit in which the blade is affixed. The cap, the blade unit, and the liquid container, when assembled, form a single applicator and scraper unit with all components contained in one assembly.

Hoyt, in U.S. Pat. No. 5,788,104, describes a combination cap and material tooling device that includes an elongated blade supported on a base, wherein the base includes an engagement portion and an intermediate portion. The engagement portion is preferably provided with threads for engaging threads on a container for a spackling stick, whereby the contents of the container may be sealed from air to preserve the contents in a soft, pliable, putty-like consistency. The intermediate portion is located between the blade and the engagement portion and includes a finger depression for receiving an operator's finger, whereby the base may be comfortably used to guide the blade in a spackling operation.

In U.S. Pat. No. 6,022,582, Van Tyle discloses a paint mask material in the form of a stick, which is housed in a lip balm or stick deodorant type of dispenser. The invention provides for the supply of a paint mask in the form of a stick constructed for immediate and convenient use by application to the surface of glass or other base to be protected from inadvertent paint. Such an application is especially suited for painting window frames and mullions, while prohibiting paint to affix itself to the glass. The invention provides for the direct application of a paint mask coating onto the material to be protected, which coating does not permit paint to adhere to the underlying surface. The present invention's ease and accuracy in application and absence of any required period for drying or setting-up overcome the disadvantages present in spraying, squeezing, rolling and brushing liquid paint masks. The painter may conveniently grip the paint mask stick dispenser and rub the tool end of the dispenser onto targeted areas of the surface to be protected. After paint is applied and dried the paint is simply wiped away with a cloth. The use of razor blades or other instruments, which might damage the underlying surface, is unnecessary.

Geremia-Nargi, in U.S. Pat. No. 6,244,773, describes an adhesive, paint and adhesive film removal tool that provides different scraping edge configurations for different substrates. The removal tool has a gripping portion, which also acts as a bottle cap, and a blade portion having a gently curved portion, a straight edge portion and a sharp edge portion allowing one to remove adhesive, paint and adhesively bound film from a variety of substrates.

In U.S. Pat. No. 6,251,468, Balter discloses a masking member that includes a substance provided to be deposited onto a surface in order to mask the latter, and protect it from outer affection. The substance being provided to be deposited is applied as an easily releasable film on the surface by being brushed against the surface. The substance is preferably a wax or fat that is used to coat a surface, such as glass, to prevent water-based paint from adhering to the glass, when painting the frame of structure holding the glass.

Owens, in U.S. Des. Pat. Nos. D 449,987 and D 462,614, shows dispenser/spreader cap devices that fit on some type of reservoir for the material to be dispensed and spread. No details of the functional features of the devices are provided.

The applicants have devised a device for storing a flowable, solid material and for applying and spreading the flowable, solid material on a generally planar surface.

SUMMARY OF THE INVENTION

The invention is a combination solid material, storage container and applicator assembly for flowable solid materials, such as surf board wax. The assembly includes a symmetrical storage container member having an open top end, an open bottom end, and an interior surface. The open bottom end has a retaining rim there around. A pusher member is positioned inside the container member, the pusher member including a sealing lip portion providing a continuous seal between the pusher member and the interior surface of the container member. The pusher member is adapted for supporting a slug of solid material within the container member. An applicator cap member is releasably secured to the open top end of the container member. The cap member includes an engagement portion releasably securing the cap member to the container member, a blade portion and a blade support portion connecting the blade portion with the engagement portion. The blade portion includes a scraper edge and a comb edge. The blade portion is adapted for manipulating a solid material on a surface.

DESCRIPTION OF THE EMBODIMENTS

Nomenclature

Figure 1:
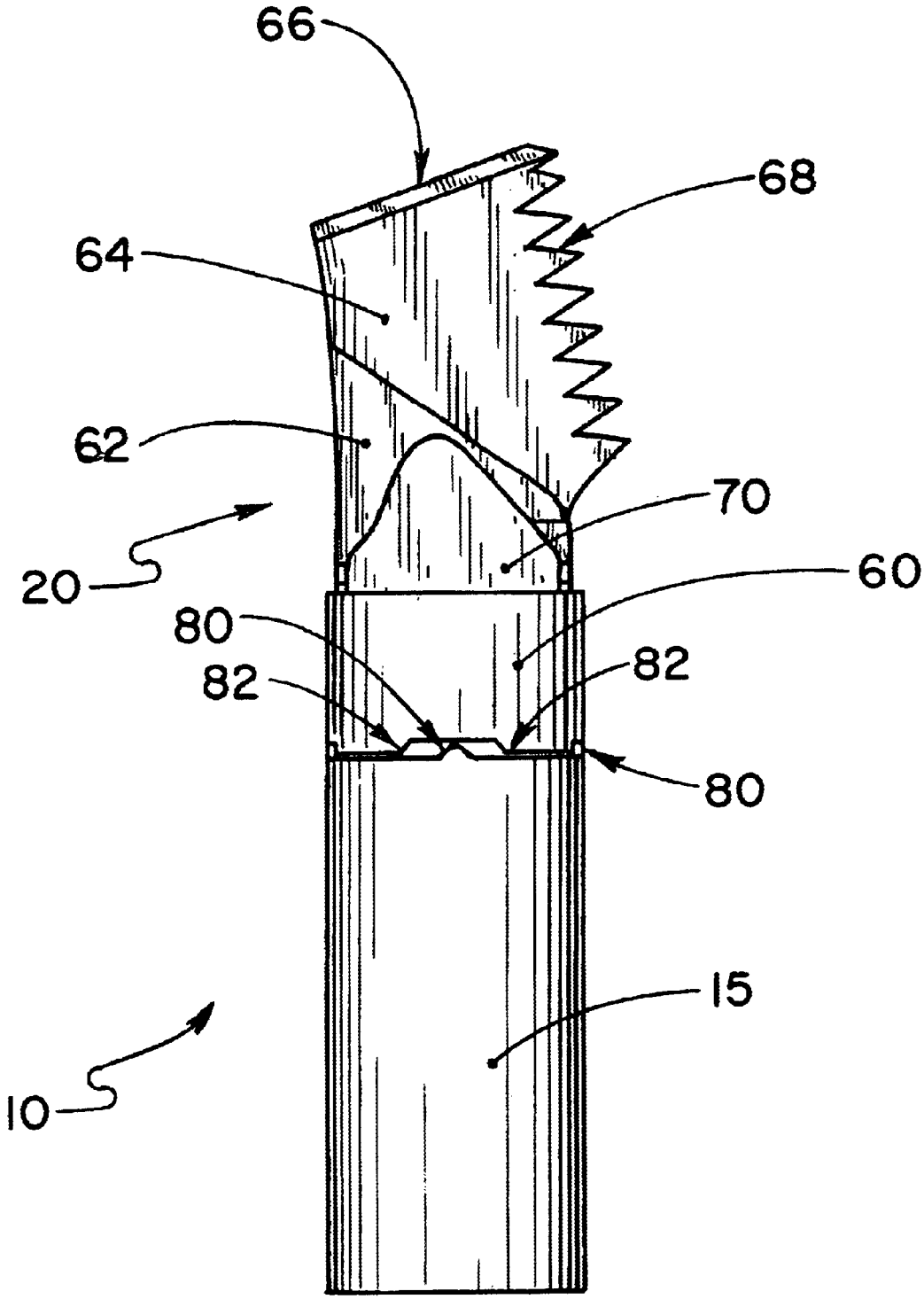
FIG. 1 is a perspective view of one embodiment of the storage and applicator assembly of the present invention.

10 Storage Container and Applicator Assembly
15 Wax Slug Storage Container Member
20 Applicator Cap Member
22 Open Top End of Container Member
24 Open Bottom End of Container Member
26 Interior Surface of Container Member
28 Reduced O.D. Top Portion of Container Member
30 Retaining Rim at Bottom End of Container Member
40 Slug Pusher Member
42 Slug Contacting Bottom End of Pusher Member
44 Sidewall of Pusher Member
46 Sealing Lip Portion of Pusher Member
50 Lock Ring Assembly
52 Lock Ring Member
54 Flap Member
60 Engagement Portion of Cap Member
62 Blade Support Portion of Cap Member
64 Blade Portion of Cap Member
66 Scraper Edge of Blade Portion
68 Comb Edge of Blade Portion 70 Finger Recess Features of Blade Support Portion
80 Stepped Circumferential Edge of Container Member
82 Stepped Circumferential Edge of Engagement Portion of Cap Member

Construction

The invention is a combination solid material storage container and applicator assembly for solid materials, such as surf board wax. The assembly includes a symmetrical storage container member having an open top end, an open bottom end, and an interior surface. The open bottom end has a retaining rim there around. A pusher member is positioned inside the container member, the pusher member including a scaling lip portion, which provides a continuous seal between the pusher member and the container member interior surface. The pusher member is adapted for supporting a slug of solid material within the container member. An applicator cap member is releasably secured to the open top end of the container member. The cap member includes an engagement portion releasably securing the cap member to the container member, a blade portion and a blade support portion, which connects the blade portion with the engagement portion. The blade portion includes a scraper edge and a comb edge. The blade portion is adapted for manipulating a solid material on a surface.

One embodiment of tile solid material, storage container and applicator assembly is designed for the storage, application and manipulation of surf board wax, as applied to a surf board. A slug of the wax is retained within the container member. Removal of the applicator cap member allows the wax slug to be pushed upward by applying force to the internal pusher member from the open bottom end of the container. A top portion of the wax slug is thus exposed beyond the open top end of the storage container. The wax is applied to a surf board by grasping the container and contacting the exposed portion of the wax slug with the surf board surface. The wax slug is then retracted into the container and the applicator cap member replaced on the open top end. The applied wax can then be manipulated by the blade portion of the applicator cap member. The comb portion of the blade is used to rough up the wax on the surf board surface, while the scraper portion of the blade is used to remove unwanted wax from the surf board surface. The storage container member provides a graspable handle for manipulating the blade portion of the assembly. Additionally, the assembly of the present invention is easily refilled with a fresh wax slug when needed.

Figure 2:
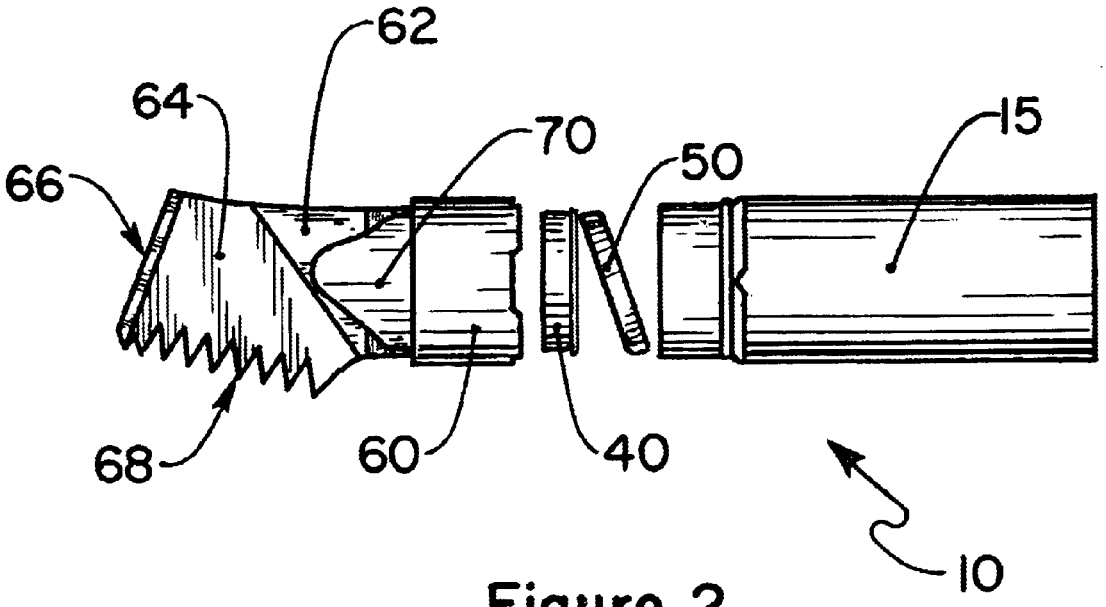
FIG. 2 is an exploded perspective view of the storage and applicator of one embodiment of the present invention.
Figure 3:
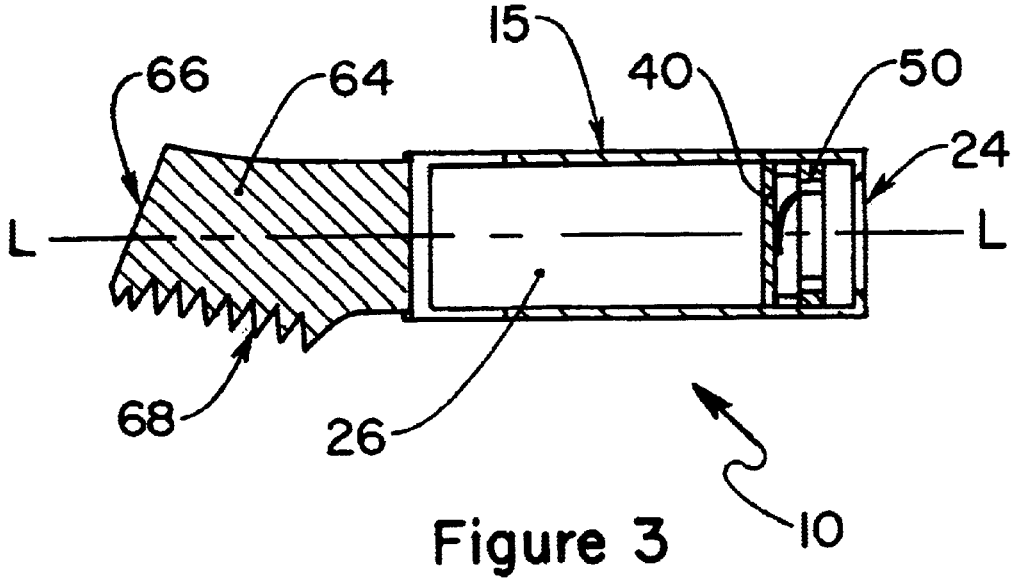
FIG. 3 is a cross sectional view of a one embodiment of the storage and applicator of the present invention.
Figure 4:
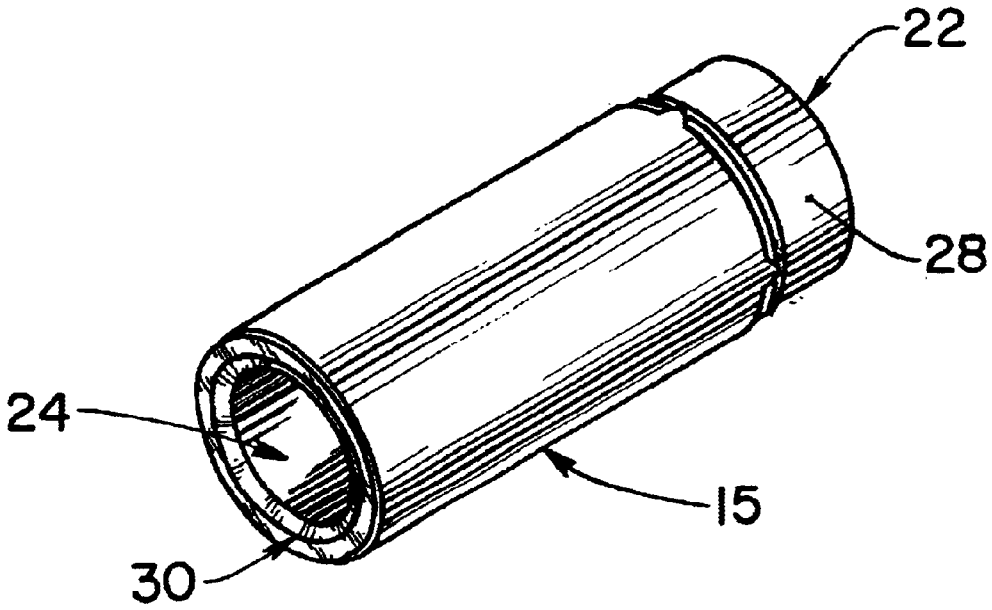
FIG. 4 is a perspective view of the storage container member of the storage and applicator assembly of the present invention.
Figure 5:
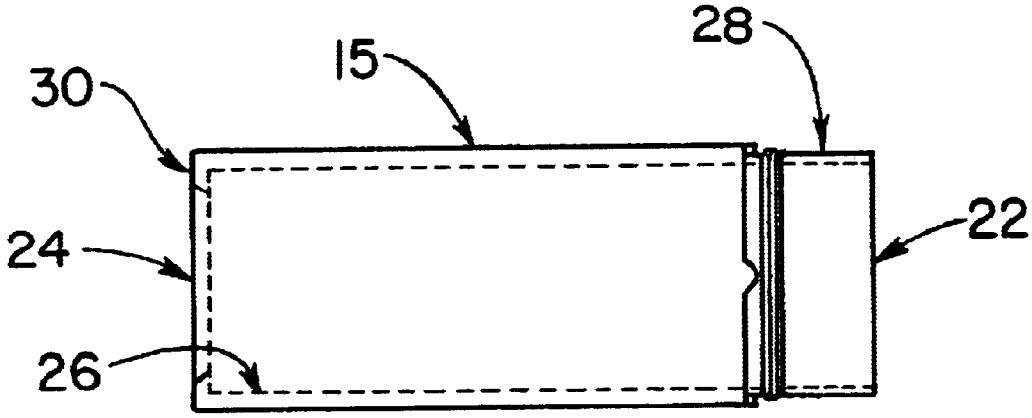
FIG. 5 is a side view of the storage container member of the storage and applicator assembly of the present invention.
Figure 6:
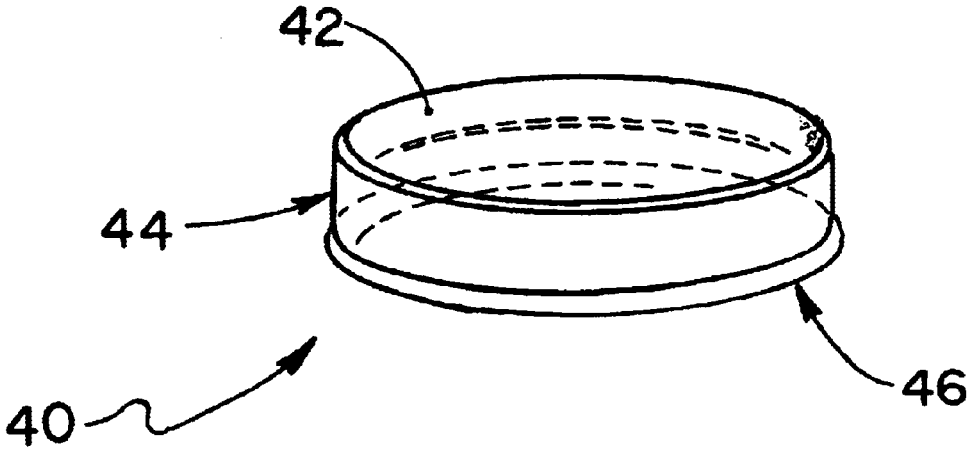
FIG. 6 is a perspective view of the pusher member of the storage and applicator assembly of the present invention.
Figure 7:
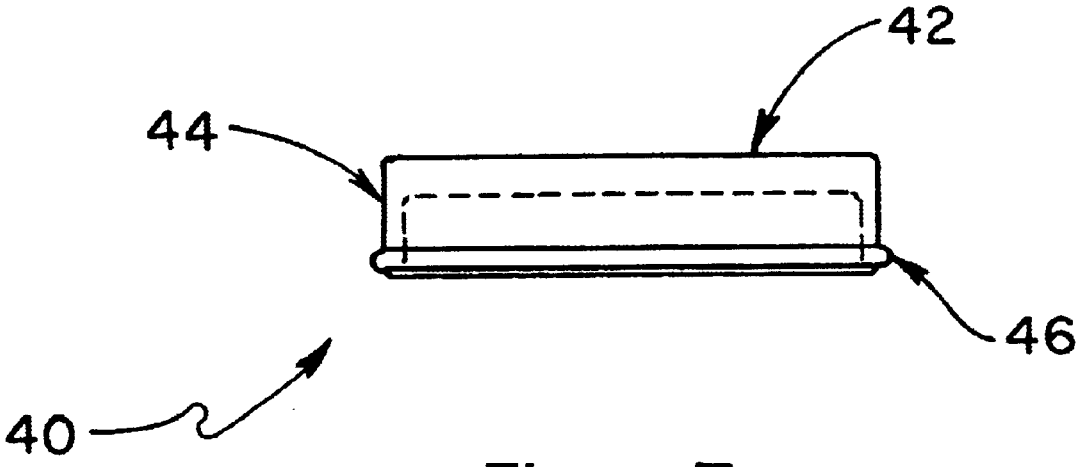
FIG. 7 is a cross sectional view of the pusher member of the storage and applicator assembly of the present invention.

Referring to FIGS. 1–5, one embodiment of the storage container and applicator assembly 10 of the present invention is shown. The assembly 10 includes a symmetrical storage container member 15 having an open top end 22, an open bottom end 24, and an interior surface 26. The open bottom end 24 has a retaining rim 30 there around, as shown in FIG. 4. The container member 15 can have any regular, polyhedral, cross sectional shape, such as rectangular, pentagonal, hexagonal or octagonal, to name a few. Preferably, the container member 15 has a circular cross section, resulting in a cylindrical container member 15, as illustrated in the figures. The container member 15 is particularly well suited for storing a slug of surf board wax having the same shape as the container member 15. A cylindrical pusher member 40 is positioned interior the container member 15. The pusher member 40 includes a sealing lip portion 46 that provides a continuous seal between the pusher member 40 and the container member interior surface 26. As shown in FIGS. 6 and 7, the pusher member 40 is preferably cup shaped with a wax slug contacting the bottom end 42 and a continuous sidewall 44 having the sealing lip portion 46 there around. The pusher member 40 is positioned within the cylindrical container member 15 with the sealing lip portion 46 adjacent to the open bottom end 24 thereof. The pusher member 40 is adapted for supporting a slug of solid material, such as surf board wax, within the cylindrical container member 15.

Preferably, the interior surface 26 of the storage container member 15 is patterned for facile axial movement of a slug of solid material therein. For example, the patterned interior surface 26 is rough or uneven, which reduces the surface tension between a wax slug and the interior surface 26, allowing for facile axial movement of the slug within the container member 15.

Figure 11:
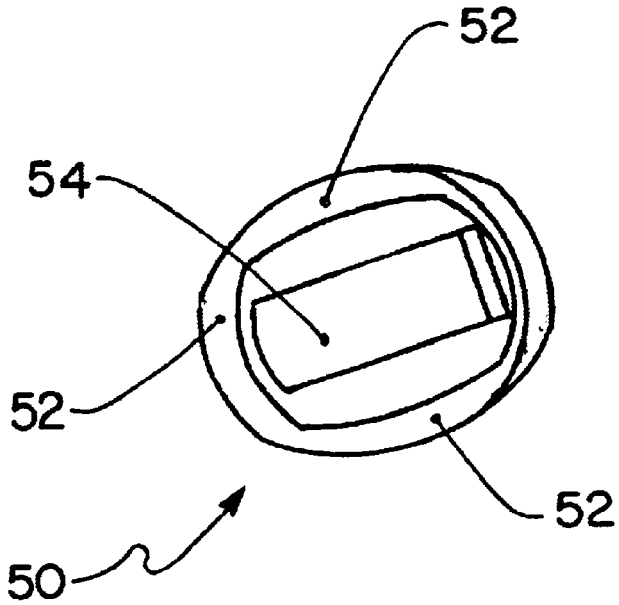
FIG. 11 is a perspective view of the lock ring assembly of the storage and applicator assembly of the present invention.
Figure 12:
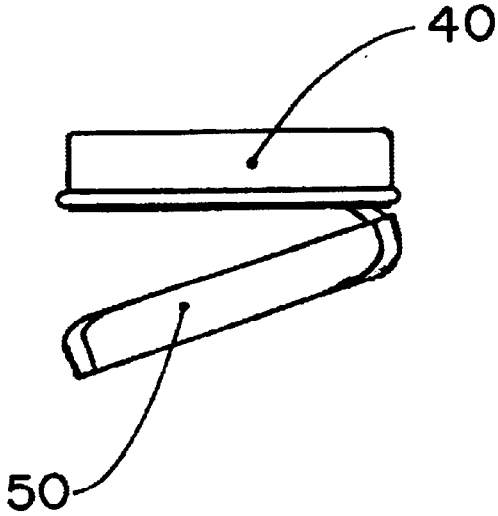
FIG. 12 is a side view of the lock ring assembly secured to the pusher member of the storage and applicator assembly of the present invention.

In a further embodiment of the invention, a lock ring assembly 50 is fastened to the pusher member 40 to secure the pusher member 40 at a selected location within the container member 15. The lock ring assembly 50, illustrated in FIGS. 11 and 12, includes a lock ring member 52 fastened by a flap member 54 to the center of the pusher member 40. In the embodiment of the invention where the container member 15 is cylindrical, the lock ring member 52 is oval with a major axis greater than the diameter of the cylindrical container member 15. The flap member 54 is secured to one edge of the lock ring member 52 and holds the lock ring member 52 at a non-perpendicular angle relative to the central axis of the cylindrical container member 15, as illustrated in FIG. 12. As the pusher member 40 is advanced up the interior of the container member 15 to expose the wax slug at the open top end 22 thereof, the pusher member 40 can be locked in place by applying force to the edge of the lock ring member 52 furthest from the pusher member 40. The lock ring member 52 thus wedges against the interior surface 26 of the container member 15, thereby holding the pusher member 40 in place, as illustrated in FIG. 3. The lock ring member 52 is released by applying downward force to move the lock ring member 52 further from horizontal, thereby freeing the pusher member 40 for retracting the wax slug into the container member 15. The locking ring member 52 can also be released by advancing the pusher member 40 toward the open top end 22 of the container member 15.

Figure 10:
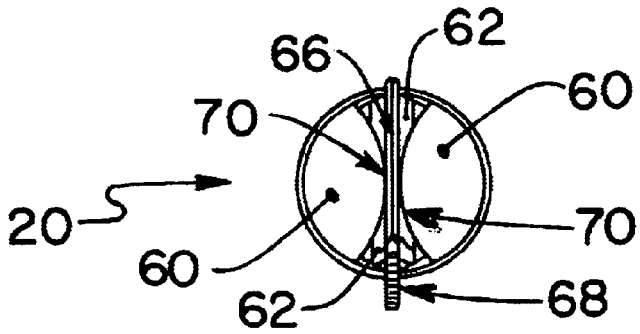
FIG. 10 is a top view of the applicator cap member of the storage and applicator assembly of the present invention.
Figure 8:
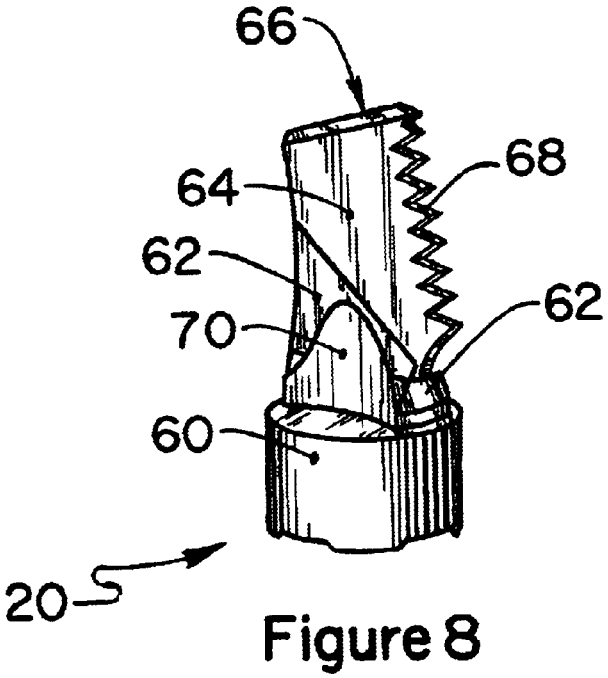
FIG. 8 is a perspective view of the applicator cap member of the storage and applicator assembly of the present invention.
Figure 9:
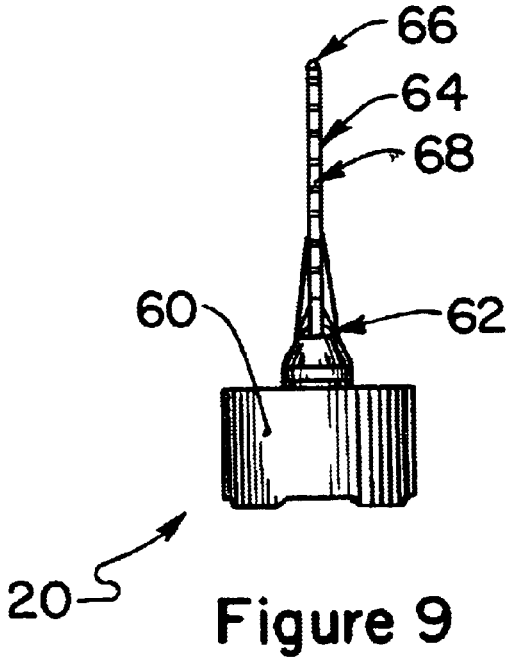
FIG. 9 is a side view of the applicator cap member of the storage and applicator assembly of the present invention.

An applicator cap member 20 is releasably secured to the open top end 22 of the cylindrical container member 15. Referring now to FIGS. 8–10, the applicator cap member 20 includes a cylindrical engagement portion 60 that releasably secures the applicator cap member 20 to the cylindrical container member 15. A blade support portion 62 connects the blade portion 64 with the cylindrical engagement portion 60 of the cap member 20. Preferably, the container member 15 includes a reduced outside diameter portion 28, adjacent to the open top end 22, for accepting the engagement portion 60 of the cap member 20, as shown in FIGS. 4 and 5.

In one embodiment of the invention, the cap member engagement portion 60 includes internal threads for engaging similar threads on the reduced outside diameter portion 28 of the container member 15. Thus, the applicator cap member 20 is rotated relative to the container member 15 to engage or disengage the applicator cap member 20 with the container member 15.

Figure 13:
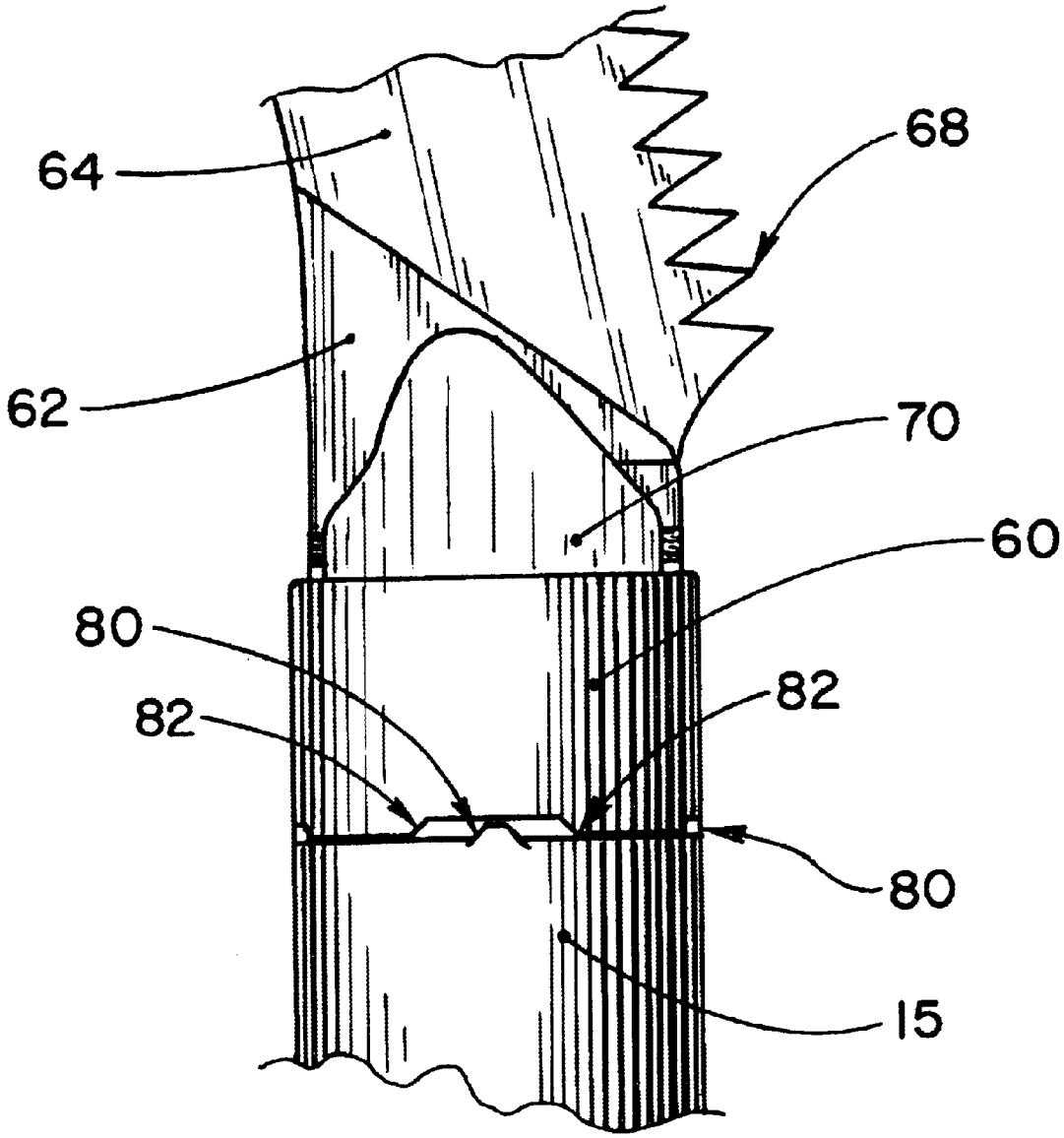
FIG. 13 is a perspective view of the stepped circumferential edges of the container member and cap member of the storage and applicator assembly of the present invention.

In another embodiment of the invention, the cap member engagement portion 60 includes an internal lip for engaging a similar lip on the reduced outside diameter portion 28 of the container member 15. Thus, the applicator cap member 20 is secured to the container member 15 by the described friction fit mechanism. In a further embodiment of the invention, the storage container member 15 and the cap member engagement portion 60 contain adjoining complementary, stepped, circumferential edges. The stepped circumferential edge 80 of the container member 15 and the stepped circumferential edge 82 of the engagement portion 60 are best seen in FIGS. 1 and 13. In this embodiment, rotating the cap member assembly 20 relative to the container member 15 displaces the cap member assembly 20 away from the open top end 22 of the storage container member 15, thereby assisting in removing the cap member assembly 20 from the storage container member 15. The stepped, circumferential edge feature operates only with the friction fit mechanism and is not compatible with the thread fastener mechanism.

The applicator cap blade portion 64 is planar and includes a scraper edge 66 and a comb edge 68, with the blade portion 64 adapted for manipulating a solid material on a surface, such as wax on the surface of a surf board. The comb edge 68 of the blade portion 64 is a saw tooth edge and preferably forms an acute angle with the central axis L of storage container member 15, as seen in FIG. 2. Thus, the comb edge 68 can contact a flat surface with the attached container member 15 angled away from the surface, with the container member 15 serving as a handle for the blade portion 64. The scraper edge 66 is preferably located at the end of the blade portion 64, opposite the cap engagement portion 60. The scraper edge 66 is preferably non-perpendicular to the central axis L of the container member 15. This orientation of the scraper edge 66 causes the material being removed by the scraper edge 66 to be displaced to one side, as opposed to accumulating on the user's hand holding the container member 15 as a handle.

Referring again to FIGS. 8–10, several more detailed views of the applicator cap member 20 are shown. The blade support portion 62 of the cap member 20 secures the blade portion 64 to the engagement portion 60 thereof. The blade support portion 62 includes opposed, finger recess features 70, defined by concave depressions therein. The finger recess features 70 are adapted for receiving the finger of a user. Thus, a user can grasp the container member 15 and position a finger in one or both of the opposed recess features 70 to provide improved control of the blade portion 64 when using the assembly 10 for manipulation of wax on a surf board surface.

The descriptions above and the accompanying materials should be interpreted in the illustrative and not the limited sense. While the invention has been disclosed in connection with the preferred embodiment or embodiments thereof, it will be understood by those skilled in the art that various changes in form and details may be made therein without departing from the spirit and scope of the invention.

I claim:

1. A combination solid material storage container and applicator assembly comprising:

(a) a symmetrical storage container member having an open top end, an open bottom end, and an interior surface, the open bottom end having a retaining rim there around;

(b) a pusher member positioned interior the container member, the pusher member including a sealing lip portion providing a continuous seal between the pusher member and the container member interior surface, the pusher member adapted for supporting a slug of solid material within the container member; and (c) an applicator cap member releasably secured to the open top end of the container member, the cap member including an engagement portion releasably securing the cap member to the container member, a blade portion and a blade support portion connecting the blade portion with the engagement portion;

(d) the blade portion including a scraper edge and a comb edge, the blade portion adapted for manipulating a solid material on a surface.

2. The combination solid material storage container and applicator assembly of claim 1, wherein the storage container member is cylindrical.

3. The combination solid material storage container and applicator assembly of claim 1, wherein the storage container member interior surface is patterned for facile movement of a slug of solid material therein.

4. The combination solid material storage container and applicator assembly of claim 1, wherein the pusher member is cup-shaped with a bottom end and a continuous sidewall with the sealing lip portion at a top edge of the sidewall.

5. The combination solid material storage container and applicator assembly of claim 4, wherein the cup-shaped pusher member is positioned within the storage container member with the sealing lip portion adjacent the open bottom end thereof.

6. The combination solid material storage container and applicator assembly of claim 1 further including a lock ring assembly for reversibly securing the pusher member at a selected position within the storage container member.

7. The combination solid material storage container and applicator assembly of claim 6, wherein the lock ring assembly includes a lock ring member fastened by a flap member to the pusher member.

8. The combination solid material storage container and applicator assembly of claim 7, wherein the storage container member is cylindrical and of a selected diameter, and the lock ring member is oval with a major axis greater than the selected diameter of the cylindrical storage member.

9. The combination solid material storage container and applicator assembly of claim 1, wherein the cap member engagement portion includes thread means for engaging threads on an exterior surface of the storage container member.

10. The combination solid material storage container and applicator assembly of claim 1, wherein the cap member engagement portion includes friction fit means for engaging an exterior surface of the storage container member.

11. The combination solid material storage container and applicator assembly of claim 1, wherein the storage container member and the cap member engagement portion contain adjoining complementary, stepped, circumferential edges, whereby rotating the cap member assembly relative to the container member displaces the cap member assembly away from the storage container member open top end.

12. The combination solid material storage container and applicator assembly of claim 1, wherein the blade portion comb edge forms an acute angle with the storage container member longitudinal axis.

13. The combination solid material storage container and applicator assembly of claim 1, wherein the blade support portion includes opposed finger recess features defined by concave depressions therein, the finger recess features adapted for receiving the finger of a user.

14. A combination solid material storage container and applicator assembly comprising:

(a) a cylindrical storage container member having an open top end, an open bottom end, and an interior surface, the open bottom end having a retaining rim there around;

(b) a cylindrical pusher member positioned interior the container member, the pusher member including a seating lip portion providing a continuous seal between the pusher member and the container member interior surface, the pusher member adapted for supporting a slug of solid material within the cylindrical container member; and (c) an applicator cap member releasably secured to the open top end of the cylindrical container member, the cap member including a cylindrical engagement portion releasably securing the cap member to the cylindrical container member, a blade portion and a blade support portion connecting the blade portion with the cylindrical engagement portion;

(d) the blade portion including a scraper edge and a comb edge, the blade portion adapted for manipulating a solid material on a surface.

15. The combination solid material storage container and applicator assembly of claim 14, wherein the cylindrical storage container member interior surface is patterned for facile movement of a slug of solid material therein.

16. The combination solid material storage container and applicator assembly of claim 14, wherein the pusher member is cup-shaped with a bottom end and a continuous sidewall with the sealing lip portion at a top edge of the sidewall, the cup-shaped pusher member positioned within the cylindrical storage container member with the sealing lip portion adjacent the open bottom end thereof.

17. The combination solid material storage container and applicator assembly of claim 14 further including a lock ring assembly for reversibly securing the pusher member at a selected position within the storage container member, the lock ring assembly including a lock ring member fastened by a flap member to the pusher member, the lock ring member being oval, with a major axis greater than the diameter of the cylindrical storage member.

18. The combination solid material storage container and applicator assembly of claim 14, wherein the cap member cylindrical engagement portion includes thread means for engaging threads on an exterior surface of the cylindrical storage container member.

19. The combination solid material storage container and applicator assembly of claim 14, wherein the cap member cylindrical engagement portion includes friction fit means for engaging an exterior surface of the cylindrical container member, the cylindrical container member and the cap member cylindrical engagement portion containing adjoining complementary, stepped, circumferential edges, whereby rotating the cap member assembly relative to the container member displaces the cap member assembly away from the storage container member open top end.

20. The combination solid material storage container and applicator assembly of claim 14, wherein the blade portion comb edge forms an acute angle with the cylindrical storage container member longitudinal axis.

21. The combination solid material storage container and applicator assembly of claim 14, wherein the blade support portion includes opposed finger recess features defined by concave depressions therein, the finger recess features adapted for receiving the finger of a user.

22. A combination solid material storage container and applicator assembly comprising:

(a) a cylindrical storage container member having an open top end, an open bottom end, and an interior surface, the open bottom end having a retaining rim there around;

(b) a cylindrical pusher member positioned interior the container member, the pusher member including a sealing lip portion providing a continuous seal between the pusher member and the container member interior surface, the pusher member positioned within the cylindrical container member with the sealing lip portion adjacent the open bottom end thereof, the pusher member adapted for supporting a slug of solid material within the cylindrical container member;

(c) a lock ring assembly for reversibly securing the pusher member at a selected position within the storage container member, the lock ring assembly including a lock ring member fastened by a flap member to the pusher member, the lock ring member being oval, with a major axis greater than the diameter of the cylindrical storage member; and (d) an applicator cap member releasably secured to the open top end of the cylindrical container member, the cap member including a cylindrical engagement portion releasably securing the cap member to the cylindrical container member, a blade portion and a blade support portion connecting the blade portion with the cylindrical engagement portion;

(e) the blade portion including a scraper edge and a comb edge, the blade portion adapted for manipulating a solid material on a surface;

(f) the blade support portion including opposed finger recess features defined by concave depressions adapted for receiving the finger of a user.

* * * * *